US006305023B1

(12) United States Patent
Barkes

(10) Patent No.: US 6,305,023 B1
(45) Date of Patent: Oct. 23, 2001

(54) PREMIUM OVEN MITT/HOT PAD

(76) Inventor: Donna J. Barkes, 892 McIntosh Dr., St. Paul, MN (US) 55124

( * ) Notice: Subject to any disclaimer, the term of this patent is extended or adjusted under 35 U.S.C. 154(b) by 0 days.

(21) Appl. No.: 09/753,886

(22) Filed: Jan. 3, 2001

(51) Int. Cl.[7] ..... A41D 13/00
(52) U.S. Cl. ..... 2/20; 2/158
(58) Field of Search ..... 2/16, 20, 158; 16/435; D29/118, 119; 38/95

(56) References Cited

U.S. PATENT DOCUMENTS

| | | | |
|---|---|---|---|
| D. 258,625 | | 3/1981 | Sheridan . |
| D. 284,520 | | 7/1986 | Handler . |
| D. 336,549 | | 6/1993 | Stahite . |
| D. 355,051 | | 1/1995 | Ives . |
| D. 368,330 | | 3/1996 | Williamson . |
| D. 381,130 | | 7/1997 | Anderson . |
| D. 388,553 | | 12/1997 | Sepin . |
| D. 425,261 | | 5/2000 | Basile . |
| 1,714,648 | * | 5/1929 | Walker . |
| 2,139,897 | * | 12/1938 | Kessler . |
| 2,391,263 | * | 12/1945 | Morton . |
| 2,810,131 | * | 10/1957 | Kogut . |
| 2,889,556 | * | 6/1959 | Mehler . |
| 2,905,946 | * | 9/1959 | Goldsmith . |
| 4,085,464 | | 4/1978 | Opelika . |
| 4,302,851 | * | 12/1981 | Adair . |
| 4,454,611 | * | 6/1984 | Tschirch et al. . |
| 4,534,066 | | 8/1985 | Hansson . |
| 4,628,544 | * | 12/1986 | Erickson . |
| 4,718,125 | * | 1/1988 | Derda . |
| 5,706,522 | * | 1/1998 | Ballarino et al. . |

FOREIGN PATENT DOCUMENTS

| | | | |
|---|---|---|---|
| 2331915 | * | 6/1999 | (GB) . |
| WO-9305670-A1 | * | 4/1993 | (WO) . |

* cited by examiner

*Primary Examiner*—Rodney M. Lindsey

(57) ABSTRACT

An oven mitt incorporating high temperature materials (14), composed of polyester fleece (10), having a flap that protects the wrist (16), stitched channels to hold the hand in place (12) which may also be used as a hot pad.

14 Claims, 3 Drawing Sheets

PREMIUM OVEN MITT/HOT PAD

BACKGROUND

1. Field of Invention

This invention relates to oven mitts and hot pads.

2. Prior Art

Consumers have a variety of oven mitts and hot pads to choose from. Many are made of thin, inexpensive material that barely protect the hand and wrist.

Heat resistant material is mentioned in U.S. Pat. No. 4,085,464 for Simonoff. This refers to fabrics padded with cotton or polyester batting. Large, very hot dishes or roasting pans can become uncomfortable to the user as it may take a few minutes to raise them out of the oven and position them so that said hot dish or pan will not damage persons or objects. High temperature materials protect people as well as kitchen counters and table tops. Existing patents do not mention high temperature materials nor use of polyester fleece.

The fit of oven mitts can be problematic. USD0388553 for Sapin, USD0425261 for Basile, USD0336549 for Stabile, and USD0355051 for Ives can shift on the hand as they are designed to be big and open. USD0368330 for Robinson suffers the opposite problem, being snug fitting and uncomfortable for a larger hand. U.S. Pat. No. 4,085,464 for Simonoff is very awkward as it requires use of both hands with an attached band of fabric that could be cumbersome.

Protection of the wrist is not part of the design of USD0425261 for Basile, USD0284520 for Handler, USD0355051 for Ives, USD0336549 for Stabile or USD0388553 for Sapin.

Oven mitts are often pressed into service as a hot pad for dinner table or kitchen counter while food preparation is completed or while the food is served. USD0309360 for Torrence, USD0258625 for Sheridan, U.S. Pat. No. 4,534,066 for Hansson, USD0381130 for Anderson, would not be attractive for this purpose.

BACKGROUND

Objects and Advantages

Accordingly, several objects and advantages of the present invention are:

(a) to provide an oven mitt incorporating high temperature materials;

(b) to provide an oven mitt composed of polyester fleece;

(c) to provide an oven mitt with protection for the wrist area;

(d) to provide an oven mitt whose fit doesn't shift;

(e) to provide and oven mitt that can be used as an attractive hot pad for dinner table or kitchen counter use.

Further objects and advantages are to provide an oven mitt that can be stored flat and stacked for storage. Still further objects and advantages will become apparent from a consideration of the ensuing description and drawings.

SUMMARY

In accordance with the present invention an oven mitt incorporating high temperature materials.

DRAWINGS

Figures FIG. 1 shows the front of the oven mitt;

DRAWINGS

Reference Numerals

10 polyester fleece
12 channel stitching
14 high temperature materials
16 protective flap

DETAILED DESCRIPTION

FIGS. 1 to 5

Figure 3:
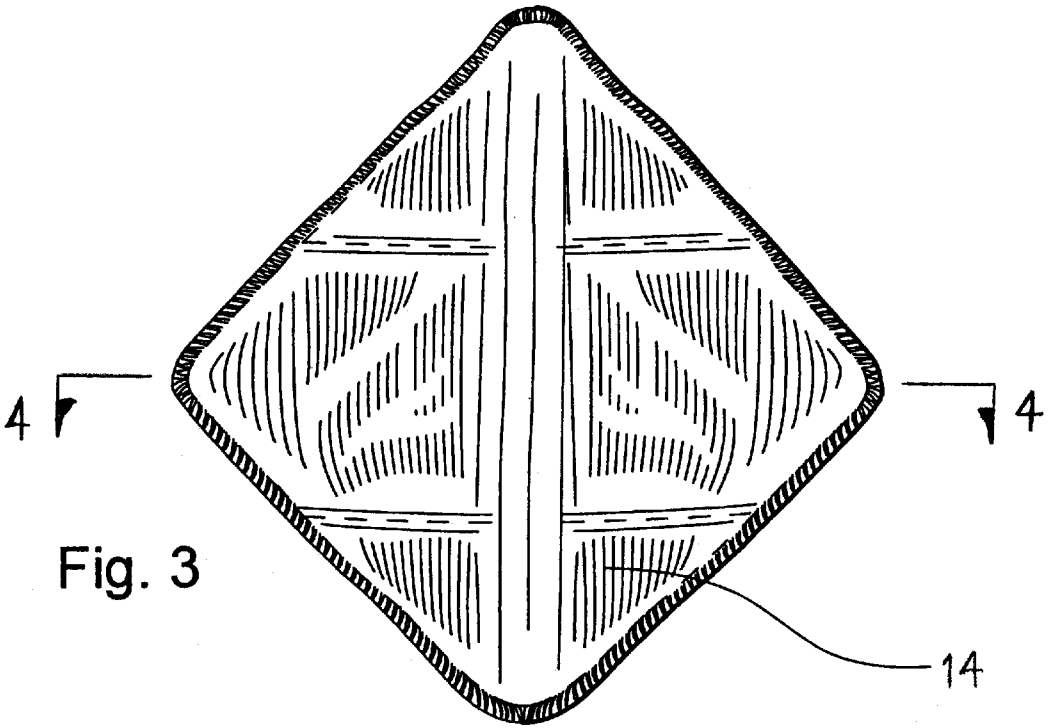
FIG. 3 shows the back of the oven mitt.
Figure 4:
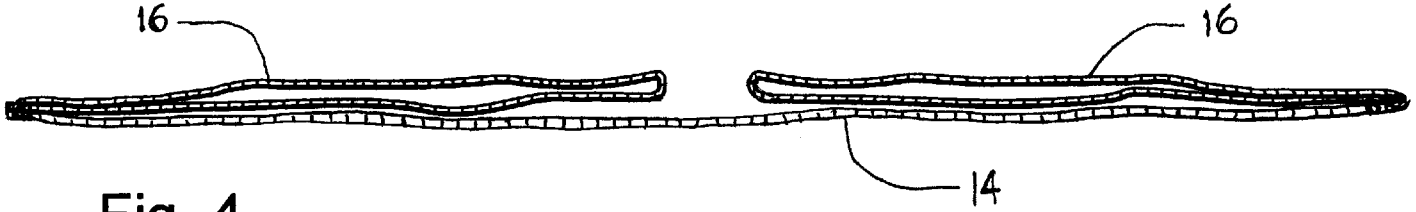
FIG. 4 is an enlarged cross-sectional view of the oven mitt taken at lines 4–4 in FIG. 3.

A typical embodiment of the oven mitt has a palm area of high temperature fabric or fabric with a high temperature coating (FIG. 3). High temperature fabric is different than heat or flame resistant fabric. Heat resistant fabric and flame resistant fabric degrade at fairly low temperatures. High temperature materials do not degrade easily. There are various fabrics in this group such as the aramids and coatings such as silicon rubber.

Figure 1:
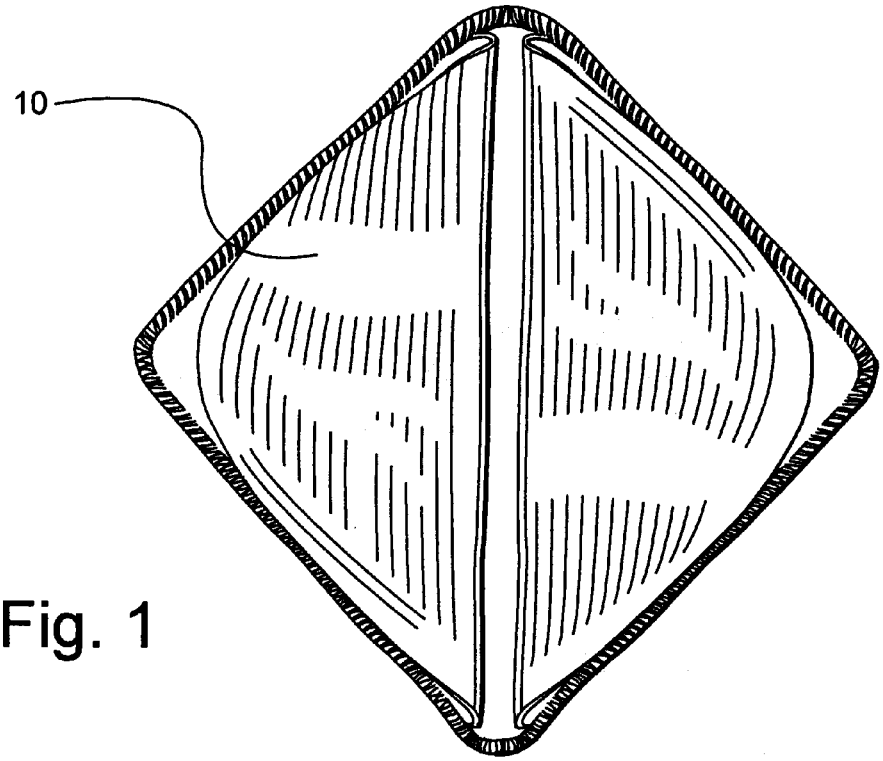
Figure 2:
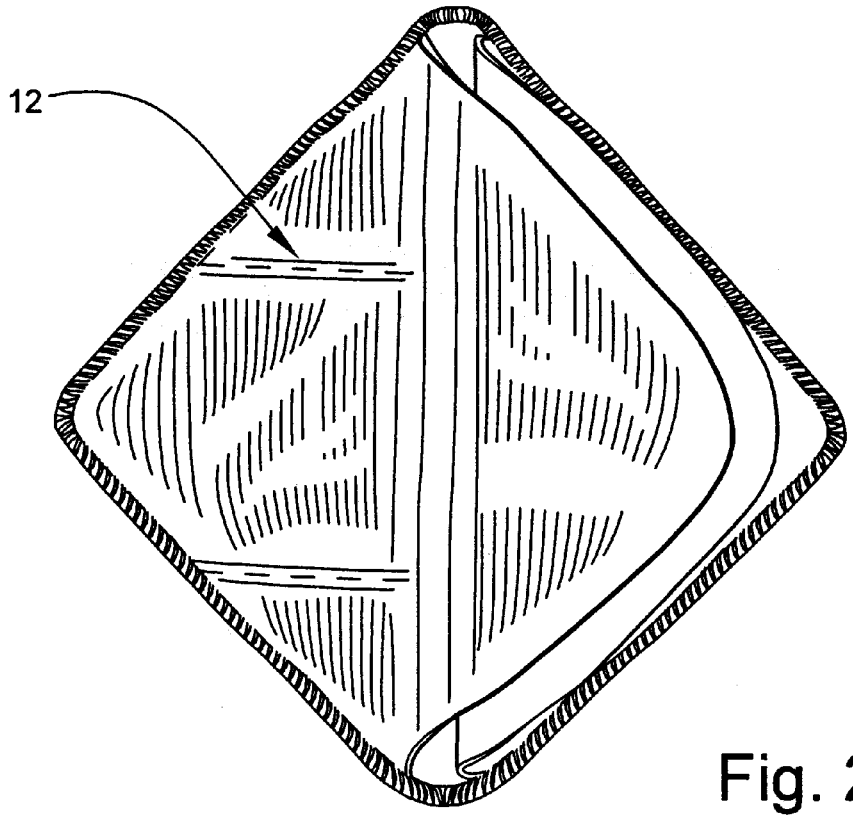
FIG. 2 shows the front with one flap pulled open to show channel stitching.
Figure 5:
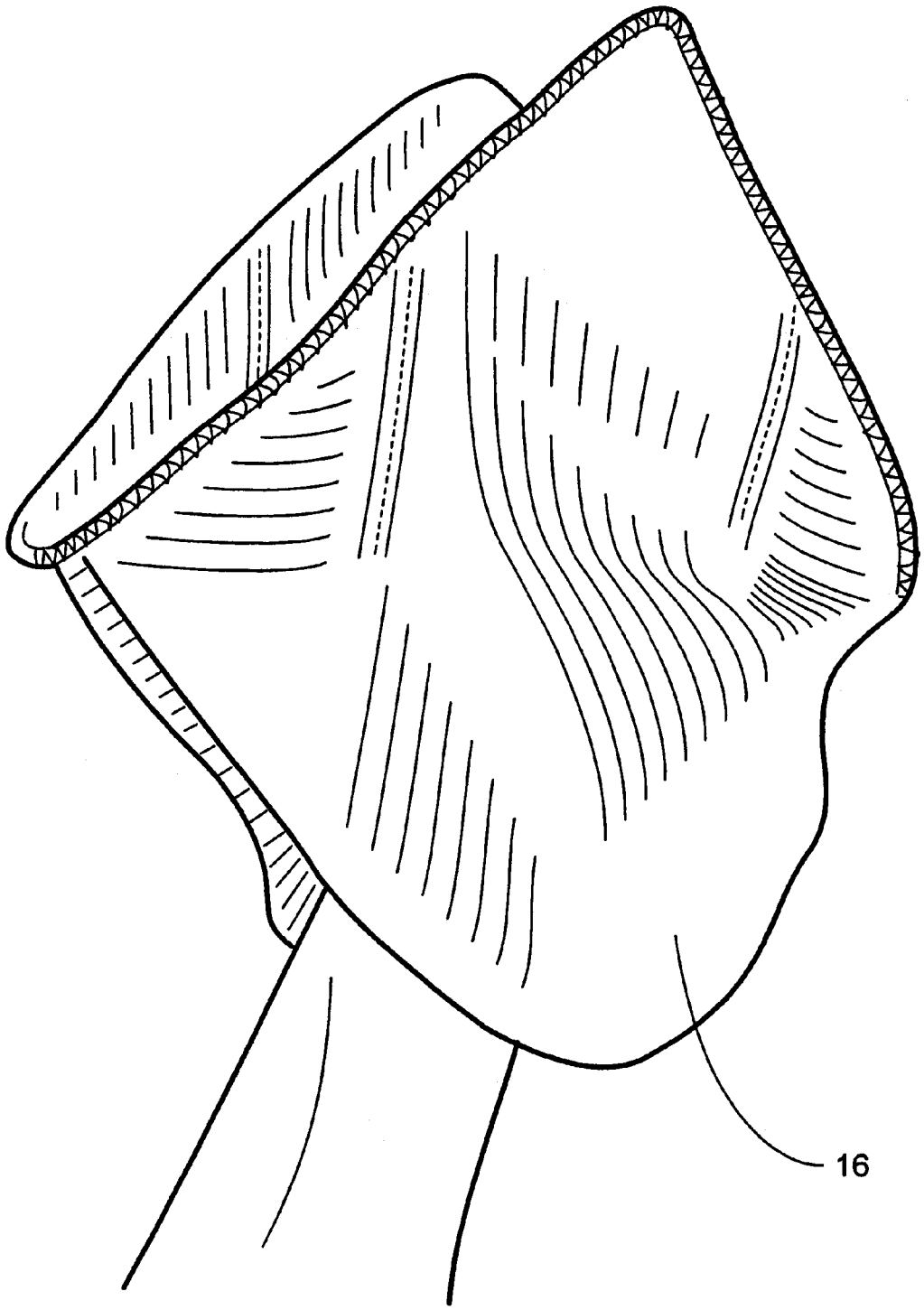
FIG. 5 shows the mitt on one's hand with protective flaps.

A typical embodiment of the oven mitt is approximately eight inches square with rounded comers. Two pieces of material of similar shape are each attached on two adjoining sides of the mitt. These two pieces of fabric form the flaps that protect the wrist (FIGS. 1, 2, 5). Polyester fleece is the preferred material because of its softness, wrinkle resistance, and variety of color and pattern.

Channel stitching on each side of the body is perpendicular to the flap, forming a hand pocket. This allows the hand to slip into the oven mitt in a consistent manner and prevent the hand position from shifting. Said stitching also anchors the flap.

These fabrics allow the oven mitt to be stored with the flaps back (FIG. 1). Because of the wrinkle resistance, attractive appearance and low profile of the mitt (FIG. 4) it can be used as a hot pad to protect furniture or counters as needed.

Operation

FIGS. 1, 5

The manner of using said oven mitt is similar to existing mitts. Place a hand, palm down, midway into the opening between the folded back flaps. Pushing thumb and fingers into the fabric pocket between the stitched channels, one slips fingers into one side, thumb into the opposite side. As the hand is raised the flaps come down to protect the wrist (FIG. 5).

Conclusions, Ramifications and Scope

Accordingly, the reader can see that consumers could easily use this oven mitt to remove hot dishes and pans into and out of an oven while protecting their hands and wrists.

This mitt would also allow consumers to use the mitt as a hot pad to protect counters and tables from being marred from the heat of items just removed from an oven.

Although the description above contains many specifics, these should not be construed as limiting the scope of the invention but as merely providing illustrations of some of the presently preferred embodiments of this invention. For example, the overall shape of the oven mitt could be round with round flaps or the mitt could be made without flaps while incorporating a high temperature coating.

Thus the scope of the invention should be determined by the appended claims and their legal equivalents, rather than by the examples given.

I claim:

1. A combination oven mitt and hot pad, comprising:

a generally rectangular base sheet of heat resistant fabric, having upper and lower faces, forward and rearward corners, opposing transverse corners, and a perimeter edge connecting all of the corners;

a first flap formed of a sheet of fabric having substantially the same shape as the base sheet and positioned on the upper face thereof, with forward and rearward corners, opposing transverse corners, and a perimeter edge connecting all of the corners, the first flap connected to the base sheet along their corresponding, juxtaposed perimeters from one transverse corner, along the forward corner, to the opposing transverse corner;

the first flap rearward corner folded back on the forward corner to form a fold line between the transverse corners;

a second flap formed of a sheet of fabric having substantially the same shape as the base sheet, with forward and rearward corners, opposing transverse corners, and a perimeter edge connecting the corners;

the second flap connected to the base sheet along their corresponding, juxtaposed perimeter from one transverse corner, along the rearward corner, to the opposing transverse corner;

the second flap forward corner folded back upon the second flap rearward corner to form a fold line parallel and adjacent the first flap fold line, between the transverse corners;

whereby the base sheet and flaps lay flat to form a hot pad, and the base sheet may be folded upon itself with the flaps extended to form an oven mitt.

2. The combination of claim 1, wherein a first fastener line connects a portion of the first flap to the base sheet, the first fastener line extending from the first flap fold line forwardly perpendicular to the fold line to the first flap and base sheet connected perimeters; and wherein a second fastener line connects a portion of the first flap to the base sheet, the second fastener line extending from the first flap fold line forwardly parallel to the first fastener line, to the first flap and base sheet connected perimeters;

said first and second fastener lines spaced apart to form a hand pocket therebetween.

3. The combination of claim 2, wherein said first and second fastener lines are lines of stitching.

4. The combination of claim 2, wherein a third fastener line connects a portion of the second flap to the base sheet, the third fastener line extending from the second flap fold line rearwardly perpendicular to the fold line to the second flap and base sheet connected perimeters; and wherein a fourth fastener line connects a portion of the second flap to the base sheet, the fourth fastener line extending from the second flap fold line rearwardly parallel to the third fastener line, to the second flap and base sheet connected perimeters;

said third and fourth fastener lines spaced apart to form a hand pocket therebetween.

5. The combination of claim 4, wherein said first, second, third and fourth fastener lines are lines of stitching.

6. The combination of claim 5, wherein the first and second stitching lines are spaced apart a distance the same as the distance between the third and fourth stitching lines.

7. The combination of claim 1, wherein each flap is formed of polyester fleece.

8. A combination oven mitt and hot pad, comprising:

a base sheet of heat resistant fabric, having upper and lower faces and a perimeter edge having a forward half and rearward half connected at opposing transverse points;

a first fabric sheet flap having substantially the same shape as the base sheet and juxtaposed on the upper face thereof, the first flap having a perimeter edge with forward and rearward halves connected at opposing transverse points;

said first flap forward perimeter half connected to the base sheet forward perimeter half;

the first flap folded upon itself with the rearward perimeter half juxtaposed over the forward perimeter half, to form a fold line between the transverse points;

a second fabric sheet flap having substantially the same shape as the base sheet and juxtaposed on the upper face thereof, the second flap having a perimeter edge with forward and rearward halves connected at opposing transverse points;

said second flap rearward perimeter half connected to the base sheet rearward perimeter half; and the second flap folded upon itself with the forward perimeter half juxtaposed over the rearward perimeter half, to form a fold line parallel and adjacent the first flap fold line, between the transverse points;

whereby the base sheet and flaps lay flat to form a hot pad, and the base sheet may be folded upon itself with the flaps extended to form an oven mitt.

9. The combination of claim 8, wherein a first fastener line connects a portion of the first flap to the base sheet, the first fastener line extending from the first flap fold line forwardly perpendicular to the fold line to the first flap and base sheet connected perimeters; and wherein a second fastener line connects a portion of the first flap to the base sheet, the second fastener line extending from the first flap fold line forwardly parallel to the first fastener line, to the first flap and base sheet connected perimeters;

said first and second fastener lines spaced apart to form a hand pocket therebetween.

10. The combination of claim 9, wherein the first and second fastener lines are lines of stitching.

11. The combination of claim 9, wherein a third fastener line connects a portion of the second flap to the base sheet, the third fastener line extending from the second flap fold line rearwardly perpendicular to the fold line to the second flap and base sheet connected perimeters; and wherein a fourth fastener line connects a portion of the second flap to the base sheet, the fourth fastener line extending from the second flap fold line rearwardly parallel to the third fastener line, to the second flap and base sheet connected perimeters;

said third and fourth fastener lines spaced apart to form a hand pocket therebetween.

12. The combination of claim 11, wherein said first, second, third and fourth fastener lines are lines of stitching.

13. The combination of claim 12, wherein the first and second stitching lines are spaced apart a distance the same as the distance between the third and fourth stitching lines.

14. The combination of claim 8, wherein each flap is formed of polyester fleece.

* * * * *